United States Patent [19]

Tomoda

[11] Patent Number: 4,742,502

[45] Date of Patent: May 3, 1988

[54] WRISTWATCH

[75] Inventor: Yoshiki Tomoda, Tokyo, Japan

[73] Assignee: Seikosha Co., Ltd., Tokyo, Japan

[21] Appl. No.: 919,846

[22] Filed: Oct. 16, 1986

[30] Foreign Application Priority Data

Feb. 10, 1986 [JP] Japan ..... 61-17911[U]

[51] Int. Cl.[4] ..... G04B 37/00; A44C 5/00

[52] U.S. Cl. ..... 368/282; 224/170

[58] Field of Search ..... 368/276, 294–296, 368/281–282; 224/164, 170

[56] References Cited

U.S. PATENT DOCUMENTS 4,023,347 5/1977 Haber ..... 368/282

4,462,697 7/1984 Thompson ..... 368/282

FOREIGN PATENT DOCUMENTS 1189909 4/1970 United Kingdom ..... 368/282

*Primary Examiner*—Vit W. Miska

*Attorney, Agent, or Firm*—Bruce L. Adams; Van C. Wilks

[57] ABSTRACT

A wristwatch comprises a watch body including a movement casing which contains a movement, and a cover mounted on the movement casing so as to cover the movement. A band has a fitting portion configured to fit onto the watch body, and a coupling assembly for coupling the watch body to the band when the fitting portion is fitted onto the watch body. The coupling assembly comprises two protruding portions provided at peripheral opposite positions of the cover, one of the protruding portions being provided with a through hole into which a pin is inserted, and a notch and a groove provided at opposite positions of the fitting portion so that the watch body can be secured in the fitting portion by inserting one protruding portion into the notch and setting the other protruding portion to the groove and then setting the pin through the band and the through hole.

8 Claims, 3 Drawing Sheets

WRISTWATCH

BACKGROUND OF THE INVENTION

The present invention relates to a wristwatch.

In known wristwatches, a watch body is composed of a barrel which constitutes a wristwatch case and which contains a movement having hands, a glass which is fixed to the front of the barrel through a frame, and a back cover which is mounted on the back of the barrel. The thus-arranged watch body and a watch band are then connected to each other by coupling the band to the respective mounting portions of the barrel which are located opposite to each other through a push-pin.

SUMMARY OF THE INVENTION

In such a wristwatch, since the watch body and the watchband which is composed of two parts are made of different materials, it is difficult to match their colors. In addition, it is troublesome to couple the wristwatch and the watch band at two positions by using push-pins. This also increases the number of parts which have to be used.

Accordingly, an object of the present invention is to provide a wristwatch which requires a reduced number of parts, which does not necessitate the matching of colors, and which allows easy replacement of a band so that the wristwatch can be treated as an apparel accessory as well.

To this end, the present inventiuon provides a wristwatch which comprises: a watch body including a movement casing containing a movement having a hand shaft protruding from the front thereof, hands mounted on the hand shaft, and a cover mounted on the movement casing in such a manner that the cover covers the hands; and a band having a fitting portion integrally formed therewith and configured to fit onto the watch body, wherein the watch body and the band are coupled with each other by fitting the fitting portion onto the watch body.

The watch body is coupled to the band by simply fitting the fitting portion of the band onto the watch body. The fitting portion of the band surrounds the time display portion, as does the barrel of known wristwatches. The fitting portion of the band is formed integrally therewith, and these eliminate the necessity for color matching.

BRIEF DESCRIPTION OF THE DRAWINGS

In the drawings which show an embodiment of the present invention.

Figure 1:
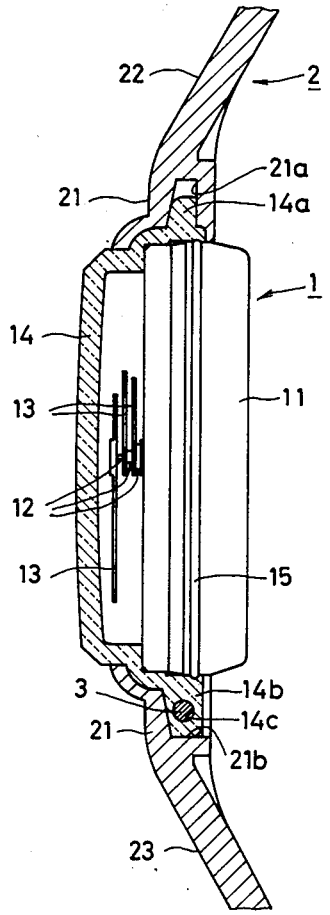
FIG. 1 is an enlarged cross-section taken along the line I—I of FIG. 6.
Figure 2:
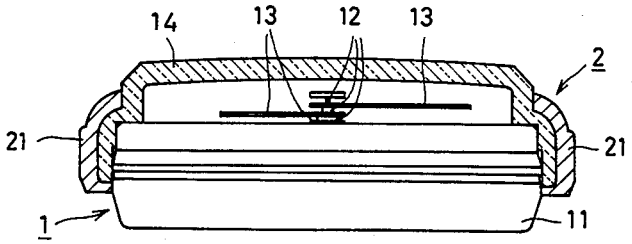
FIG. 2 is an enlarged cross-section taken along the line II—II of FIG. 6.
Figure 3:
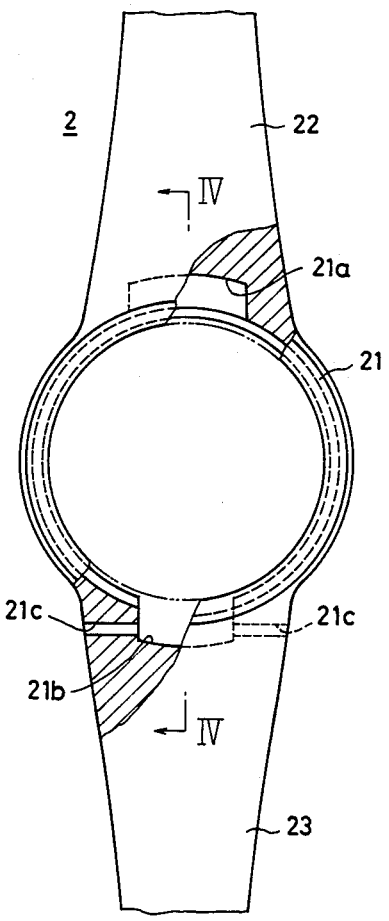
FIG. 3 is a front elevational view of an essential part of a band with portions broken away.
Figure 4:
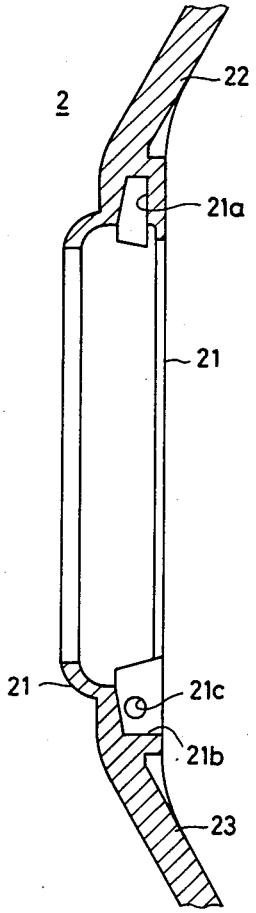
FIG. 4 is an enlarged cross-section taken along the line IV—IV of FIG. 3.
Figure 5:
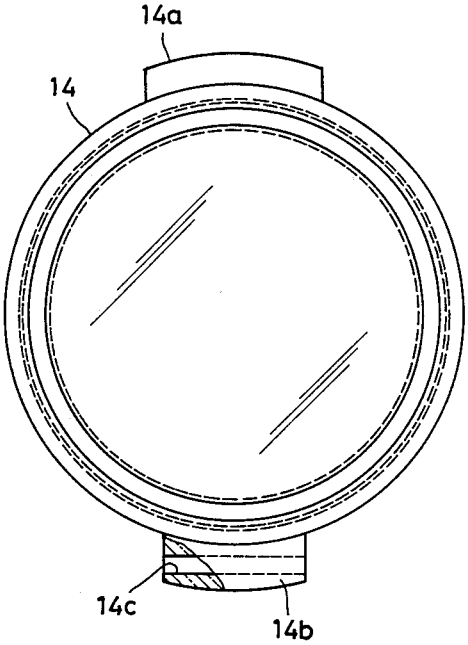
FIG. 5 is a front elevational view of a cover with portions broken away; and As shown in FIGS. 1 and 2, a wristwatch of the present invention is composed of a watch body 1 and a band 2. The watch body 1 has a movement casing 11 which contains a watch movement (not shown), hands 13 mounted on a hand shaft 12 protruding from the movement casing, and a transparent cover 14 has a front portion and a dependent portion which covers the hands. In this embodiment, the cover 14 fitted to the outer periphery of the movement casing 11 tightly through a waterproof ring 15 so as to provide a highly waterproof watch body 1. The band 2, as shown in FIGS. 3 and 4, has a fitting central portion which fits around the outer periphery of the watch body 1, and band or strap portions 22 and 23 which extend outward from the upper and lower opposite portions of the fitting portions and which are integrally formed therewith. The band 2 is made of a urethane resin which is strong and slightly resilient or flexible.

The watch body 1 and the band 2 are coupled to each other by forcibly fitting the fitting portion 21 of the band 2 onto the outer periphery of the watch body 1. To insure the coupling, the cover 14 has upper and lower oppositely protruding portions **14*a* and 14*b*, as shown in an enlarged manner and as seen from the front side in FIG. 5. The protrusion 14*b* has a through-hole 14*c* which passes through the protrusion 14*b* transversely in the crosswise direction. The band has on the inner periphery of its fitting portion 21 a groove or cavity 21*a* into which the protrusion 14*a* can be fitted and a notch or cavity 21*b* into which the protrusion 14*b* is inserted. Through-holes 21*c* are provided in one of the strip 23 to transversely extend to communicate with the notch 21*b* so as to be aligned with the through-hole 14*c*, so that a coupling pin 3 (shown in FIG. 1) may pass through the through-holes 21*c*, 14*c* and 21*c* to secure the watch body 1 to the band 2**.

The protruston **14*a* of this embodiment protrudes from the cover 14. However, it is not limited to this form and may be protruded from the movement casing 11. The coupling of the cover 14 and the movement casing 11** is not limited to the form shown in Figures, and it may be accomplished through the intermediary of a coupling member.

Figure 6:
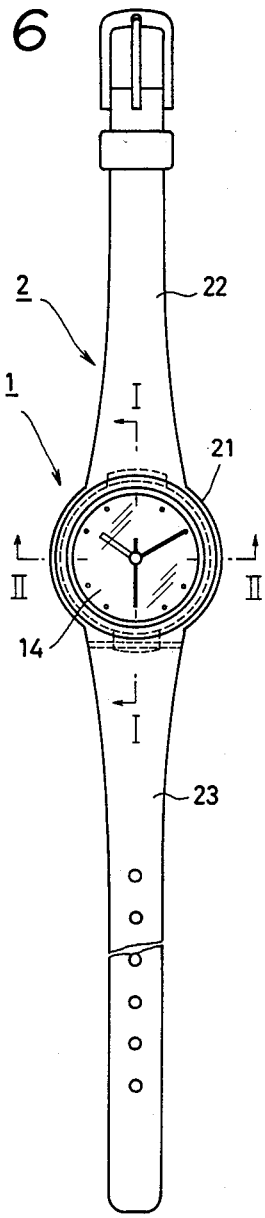

When coupling the watch body 1 and the band 2, the protrusion **14*b* is first inserted into the notch 21*b*. The pin 3 is then inserted through the through-holes 21*c*, 14*c* and 21*c*. Sequentially, the protrusion 14*a* is fitted into the groove 21*a* while the fitting portion 21 is fitted onto the outer periphery of the watch body 1. As a result, as shown in FIG. 6, the fitting portion 21 of the band 2 surrounds the periphery of the time display portion when the watch is viewed from the front, and the band portions 22 and 23 extend from the fitting portion 21. The movement casing 11 which is made of a different material is therefore invisible from the front so that the watch body 1 and the band 2** appears as one body.

As will be understood from the foregoing description, the watch body can be easily coupled to the band by fitting the fitting portion of the band onto the watch body. In addition, the watch body is surrounded by the fitting portion of the band which is integrally formed therewith, and this allows an easy adjustment of the color of a wristwatch and eliminates the need for color matching of the components. The simple coupling of the band to the watch body allows the user to wear the wristwatch as an apparel accesssory, using interchangeable several types of bands of different colors and shapes and replacing the band by him or herself.

I claim:

1. A wristwatch comprising a watch body including a movement casing for containing therein a movement, hand shafts protruding from the front face of the movement casing, hands mounted on said hand shafts, and a cover mounted on said movement casing so as to cover said hands; a band having a fitting portion integrally formed therewith, said fitting portion being configured to fit onto said watch body; and coupling means for coupling said watch body to said band when said fitting portion is fitted onto said watch body, said coupling means comprising a pin, two protrusions provided at peripheral opposite portions of said cover, one protrusion being provided with a through hole for receiving therein the pin, and a notch and a groove provided oppositely at the fitting portion so that said watch body can be secured in said fitting portion by inserting said one protrusion into said notch and setting the other protrusion to said groove and then setting said pin through said band and said through hole.

2. A wristwatch comprising: a casing; a watch movement mounted in the casing; a cover mounted on the casing and having a front portion covering the watch movement and a dependent portion secured around an outer peripheral portion of the casing; a band having a central portion configured to fit around the dependent portion and to surround the front portion, and a pair of strap portions extending outwardly from the central portion in opposed relation to the central portion; and coupling means for coupling the band to the dependent portion, the coupling means including means defining a pair of cavities extending longitudinally in respective ones of the strap portions and opening at the central portion, a first through-hole extending transversely of one strap portion and communicating with one of the strap portion cavities, a pair of protrusions extending outwardly from the dependent portion in opposed relation relative to the front portion, one of the protrusions having a second through-hole extending transversely thereof, said one protrusion being removably inserted into said one cavity with the first and second through-holes aligned with each other and the other protrusion being removably inserted into the other cavity, and a pin removably inserted into the aligned through-holes to releasably couple said one protrusion to said one strap portion.

3. A wristwatch according to claim 2; wherein the central portion of the band comprises an annular central portion.

4. A wristwatch according to claim 2; wherein the central and strap portions comprise an integrated one-piece structure.

5. A wristwatch according to claim 2; wherein the band comprises a flexible band.

6. A wristwatch according to claim 5; wherein the flexible band is composed of a urethane resin.

7. A wristwatch according to claim 2; including a ring disposed between the peripheral portion of the casing and the dependent portion of the cover for effecting a water-resistant seal therebetween.

8. A wrist watch according to claim 2; wherein the watch movement includes a hand shaft, and a hand mounted on the hand shaft and driven by the hand shaft.

* * * * *